US007867376B2

(12) United States Patent
Browne et al.

(10) Patent No.: US 7,867,376 B2
(45) Date of Patent: Jan. 11, 2011

(54) TREATMENT OF HYDROCARBON FLUIDS WITH OZONE

(75) Inventors: Neale Browne, Houston, TX (US); Catalin Ivan, Houston, TX (US)

(73) Assignee: M-I L.L.C., Houston, TX (US)

( * ) Notice: Subject to any disclaimer, the term of this patent is extended or adjusted under 35 U.S.C. 154(b) by 770 days.

(21) Appl. No.: 11/114,929

(22) Filed: Apr. 25, 2005

(65) Prior Publication Data

US 2005/0247599 A1 Nov. 10, 2005

Related U.S. Application Data

(60) Provisional application No. 60/603,171, filed on Aug. 20, 2004, provisional application No. 60/565,316, filed on Apr. 26, 2004.

(51) Int. Cl.
*C10G 71/00* (2006.01)

(52) U.S. Cl. ..... 208/3; 34/265; 34/389; 34/576

(58) Field of Classification Search ..... 208/3, 208/400; 34/265, 389, 576
See application file for complete search history.

(56) References Cited

U.S. PATENT DOCUMENTS

| | | | | |
|---|---|---|---|---|
| 2,955,123 | A | 10/1960 | Favis | |
| 3,145,217 | A | 8/1964 | Horeczy et al. | |
| 3,551,328 | A | 12/1970 | Edward et al. | |
| 3,945,918 | A | 3/1976 | Kirk | |
| 4,104,129 | A | 8/1978 | Fields et al. | |
| 4,314,902 | A * | 2/1982 | Bouk et al. | 208/254 R |
| 4,319,410 | A | 3/1982 | Heilhecker et al. | |
| 4,401,553 | A | 8/1983 | Faudel | |
| 5,127,343 | A | 7/1992 | O'Ham | |
| 5,205,927 | A | 4/1993 | Wickramanayake | |
| 5,591,893 | A | 1/1997 | Kulpe et al. | |
| 5,637,231 | A * | 6/1997 | Hill et al. | 210/748 |
| 5,753,494 | A | 5/1998 | Hater et al. | |
| 5,968,370 | A | 10/1999 | Trim | |
| 6,399,851 | B1 | 6/2002 | Siddle | |
| 6,658,757 | B2 * | 12/2003 | Fout et al. | 34/76 |
| 7,022,241 | B2 | 4/2006 | Kerfoot | |
| 2006/0163117 | A1 | 7/2006 | Hong | |

FOREIGN PATENT DOCUMENTS

| | | | |
|---|---|---|---|
| DE | 4016899 | | 12/1991 |
| DE | 4016899 | C * | 5/1993 |
| GB | 367848 | A | 2/1932 |
| WO | 0129153 | | 4/2001 |
| WO | 0196249 | | 12/2001 |
| WO | WO0196249 | A * | 12/2001 |
| WO | 2005104769 | A2 | 11/2005 |

OTHER PUBLICATIONS

International Search Report issued in PCT/US20/05014530 dated Jun. 21, 2007 (3 pages).
Written Opinion issued in PCT/US20/05014530 dated Jun. 21, 2007 (3 pages).
Canadian Official Action issued in Application No. 6,564,459 dated Apr. 6, 2009 (3 pages).
US Office Action issued in U.S. Appl. No. 11/877,494 dated May 1, 2009 (9 pages).
Office Action issued in related European Application No. 05742095.2 dated Jan. 21, 2010. (3 pages).
Extended Search Report for related European Application No. 05742095.2 dated Oct. 27, 2009. (3 pages).
"A New Method for Obtaining Ultra-low sulfur Diesel Fuel Via Ultrasound Assisted Oxidative Desulfurization" Hai Mei, et al. FUEL; vol. 82; Sep. 22, 2002-Oct. 22, 2002; pp. 405-415.
Notification Concerning Transmittal of International Preliminary Report on Patentability with Written Opion of the International Searching Authority (4 pages).
Office Action issued in the U.S. Appl. No. 11/877,494 dated Aug. 4, 2010 (22 pages).
Office Action issued in Canadian Application No. 2,564,459 dated Jul. 28, 2010 (1 page).

* cited by examiner

*Primary Examiner*—Glenn A Caldarola
*Assistant Examiner*—Taiwo Oladapo
(74) *Attorney, Agent, or Firm*—Osha Liang LLP

(57) ABSTRACT

A method of treating a hydrocarbon fluid that includes contacting the hydrocarbon fluid with an effective amount of ozone. A method for separating contaminants from a contaminated material includes supplying the contaminated material to a processing chamber, moving the contaminated material through the processing chamber, heating the contaminated material by externally heating the processing chamber so as to volatilize the contaminants in the contaminated material, removing vapor resulting from the heating, wherein the vapor comprises the volatilized contaminants, collecting, condensing, and recovering the volatilized contaminants, and contacting the volatilized contaminants with an effective amount of ozone.

11 Claims, 4 Drawing Sheets

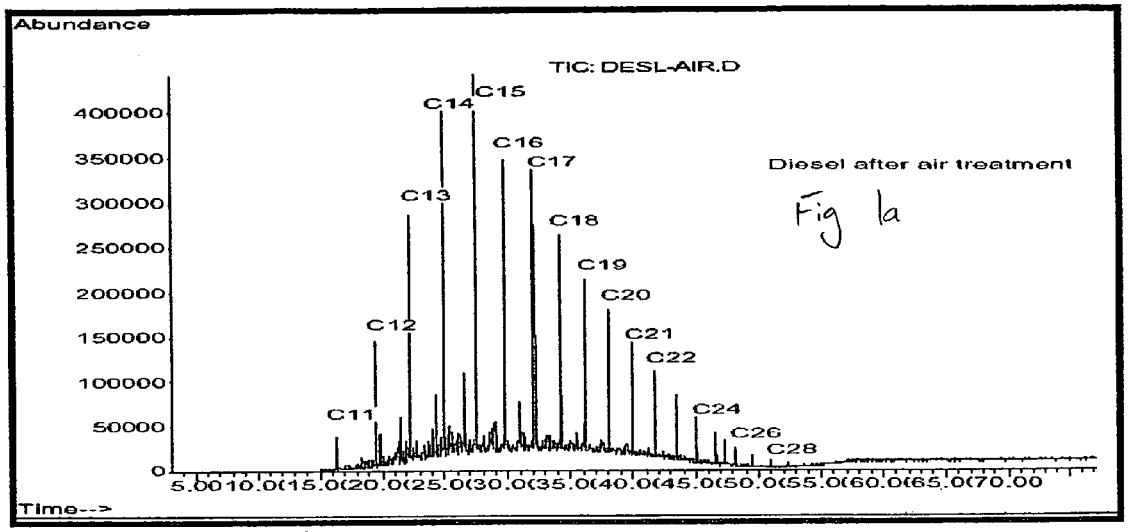
TPS-1- Recovered diesel after air treatment
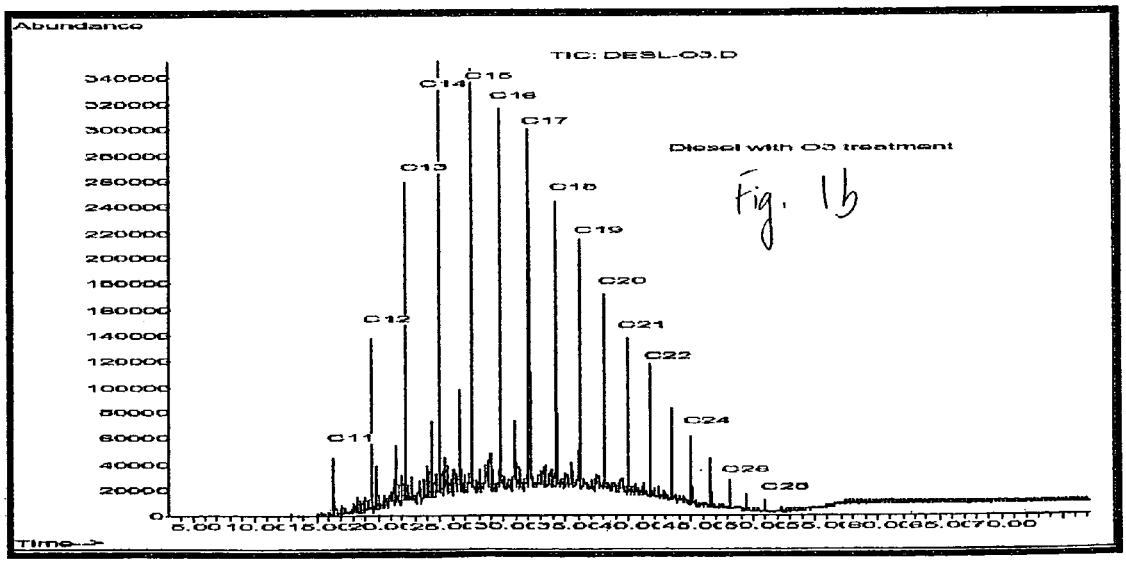
TPS-2- Recovered diesel after ozone treatment

Extracted ion scan of TPS-1

Extracted ion scan of TPS-2

TREATMENT OF HYDROCARBON FLUIDS WITH OZONE

CROSS-REFERENCE TO RELATED APPLICATIONS

This application claims priority, pursuant to 35 U.S.C. §119(e), to both U.S. Provisional Application No. 60/603,171 filed Aug. 20, 2004 and U.S. Provisional Application No. 60/565,316 filed Apr. 26, 2004. Both of these applications are incorporated by reference in their entirety.

BACKGROUND OF INVENTION

When drilling or completing wells in earth formations, various fluids typically are used in the well for a variety of reasons. For purposes of description of the background of the invention and of the invention itself, such fluids will be referred to as "well fluids." Common uses for well fluids include: lubrication and cooling of drill bit cutting surfaces while drilling generally or drilling-in (i.e., drilling in a targeted petroleum bearing formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, implacing a packer fluid, abandoning the well or preparing the well for abandonment, and otherwise treating the well or the formation.

As stated above, one use of well fluids is the removal of rock particles ("cuttings") from the formation being drilled. A problem arises in disposing these cuttings, particularly when the drilling fluid is oil-based or hydrocarbon-based. That is, the oil from the drilling fluid (as well as any oil from the formation) becomes associated with or adsorbed to the surfaces of the cuttings. The cuttings are then an environmentally hazardous material, making disposal a problem.

A variety of methods have been proposed to remove adsorbed hydrocarbons from the cuttings. U.S. Pat. No. 5,968,370 discloses one such method which includes applying a treatment fluid to the contaminated cuttings. The treatment fluid includes water, a silicate, a nonionic surfactant, an anionic surfactant, a phosphate builder and a caustic compound. The treatment fluid is then contacted with, and preferably mixed thoroughly with, the contaminated cuttings for a time sufficient to remove the hydrocarbons from at least some of the solid particles. The treatment fluid causes the hydrocarbons to be desorbed and otherwise disassociated from the solid particles.

Furthermore, the hydrocarbons then form a separate homogenous layer from the treatment fluid and any aqueous component. The hydrocarbons are then separated from the treatment fluid and from the solid particles in a separation step, e.g., by skimming. The hydrocarbons are then recovered, and the treatment fluid is recycled by applying the treatment fluid to additional contaminated sludge. The solvent must be processed separately.

Some prior art systems use low-temperature thermal desorption as a means for removing hydrocarbons from extracted soils. Generally speaking, low-temperature thermal desorption (LTTD) is an ex-situ remedial technology that uses heat to physically separate hydrocarbons from excavated soils. Thermal desorbers are designed to heat soils to temperatures sufficient to cause hydrocarbons to volatilize and desorb (physically separate) from the soil. Typically, in prior art systems, some pre- and post-processing of the excavated soil is required when using LTTD. In particular, excavated soils are first screened to remove large cuttings (e.g., cuttings that are greater than 2 inches in diameter). These cuttings may be sized (i.e., crushed or shredded) and then introduced back into a feed material. After leaving the desorber, soils are cooled, re-moistened, and stabilized (as necessary) to prepare them for disposal/reuse.

U.S. Pat. No. 5,127,343 (the '343 patent) discloses one prior art apparatus for the low-temperature thermal desorption of hydrocarbons. FIG. 1 from the '343 patent reveals that the apparatus consists of three main parts: a soil treating vessel, a bank of heaters, and a vacuum and gas discharge system. The soil treating vessel is a rectangularly shaped receptacle. The bottom wall of the soil treating vessel has a plurality of vacuum chambers, and each vacuum chamber has an elongated vacuum tube positioned inside. The vacuum tube is surrounded by pea gravel, which traps dirt particles and prevents them from entering a vacuum pump attached to the vacuum tube.

The bank of heaters has a plurality of downwardly directed infrared heaters, which are closely spaced to thoroughly heat the entire surface of soil when the heaters are on. The apparatus functions by heating the soil both radiantly and convectionly, and a vacuum is then pulled through tubes at a point furthest away from the heaters. This vacuum both draws the convection heat (formed by the excitation of the molecules from the infrared radiation) throughout the soil and reduces the vapor pressure within the treatment chamber. Lowering the vapor pressure decreases the boiling point of the hydrocarbons, causing the hydrocarbons to volatize at much lower temperatures than normal. The vacuum then removes the vapors and exhausts them through an exhaust stack, which may include a condenser or a catalytic converter.

In light of the needs to maximize heat transfer to a contaminated substrate using temperatures below combustion temperatures, U.S. Pat. No. 6,399,851 discloses a thermal phase separation unit that heats a contaminated substrate to a temperature effective to volatize contaminants in the contaminated substrate but below combustion temperatures. As shown in FIGS. 3 and 5 of U.S. Pat. No. 6,399,851, the thermal phase separation unit includes a suspended air-tight extraction, or processing, chamber having two troughs arranged in a "kidney-shaped" configuration and equipped with rotating augers that move the substrate through the extraction chamber as the substrate is indirectly heated by a means for heating the extraction chamber.

In addition to the applications described above, those of ordinary skill in the art will appreciate that recovery of adsorbed hydrocarbons is an important application for a number of industries. For example, a hammermill process is often used to recover hydrocarbons from a solid. One recurring problem, however, is that the recovered hydrocarbons, whether they are received by either of the methods described above or whether by another method, can become degraded, either through the recovery process itself, or by the further use of the recovered hydrocarbons.

This degradation may result in pungent odors, decreased performance, discoloration, and/or other factors which will be appreciated by those having ordinary skill in the art. What is needed, therefore, are methods and apparatuses for improving the properties of recovered hydrocarbons.

SUMMARY OF INVENTION

In one aspect, the present invention relates to a method of treating a hydrocarbon fluid that includes contacting the hydrocarbon fluid with an effective amount of ozone.

In another aspect, the present invention relates to a method for separating contaminants from a contaminated material that includes the steps of supplying the contaminated material to a processing chamber, moving the contaminated material through the processing chamber, heating the contaminated material by externally heating the processing chamber so as to volatilize the contaminants in the contaminated material, removing vapor resulting from the heating, wherein the vapor comprises the volatilized contaminants, collecting, condensing, and recovering the volatilized contaminants, and contacting the volatilized contaminants with an effective amount of ozone.

In yet another aspect, the present invention relates to a system for separating contaminants from a material that includes a processing chamber, a heat source connected to the processing chamber adapted to vaporize hydrocarbons and other contaminants disposed on the material, a condenser operatively connected to an outlet of the process chamber and adapted to condense the vaporized hydrocarbons and other contaminants, and an ozone source operatively connected to the condenser.

Other aspects and advantages of the invention will be apparent from the following description and the appended claims.

BRIEF DESCRIPTION OF DRAWINGS

FIG. 1*a* is a GC/MS trace of an untreated sample of hydrocarbon fluid;

FIG. 1*b* is a GC/MS trace of a sample of hydrocarbon fluid treated in accordance with one embodiment of the present invention;

DETAILED DESCRIPTION

Figure 2A:
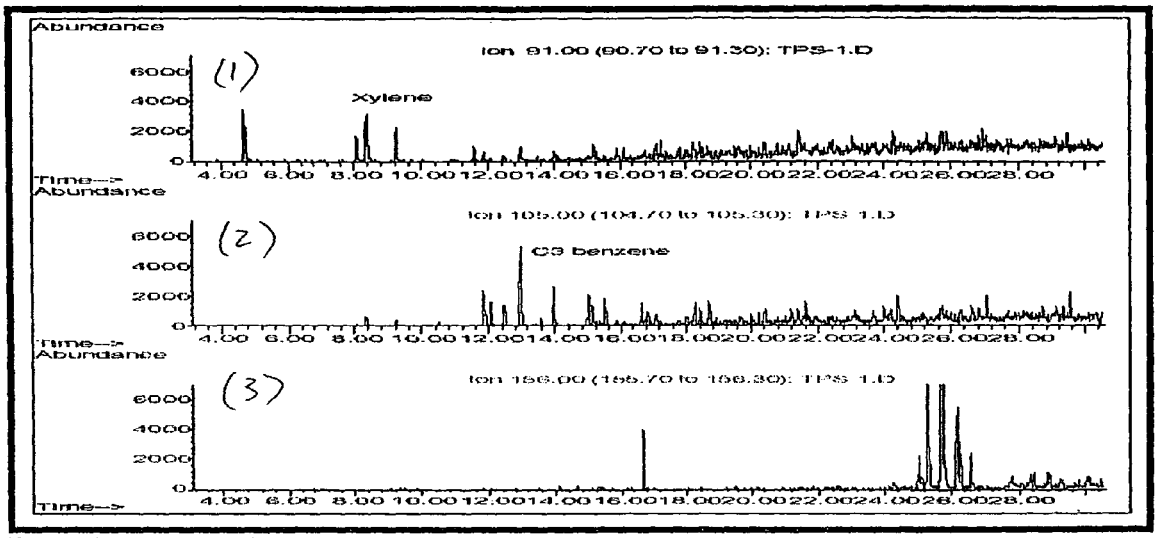
FIG. 2*a* is an extracted ion scan of an untreated sample of hydrocarbon fluid.

In one or more aspects, the present invention relates to methods and apparatuses for treating hydrocarbons. In particular, aspects of the present invention relate to methods and apparatuses for treating hydrocarbons that have been recovered from solid materials.

As noted above, a number of prior art methodologies for recovering adsorbed hydrocarbons from "cuttings" (i.e., rock removed from an earth formation) are currently used by hydrocarbon producers. While the present invention is not limited to this industry, the embodiments described below discuss the process in that context, for ease of explanation. In general, embodiments of the present invention may be applied to any "cracked" hydrocarbon fluid. A "cracked" hydrocarbon fluid is one where at least some of the "higher" alkanes present in a fluid have been converted into "smaller" alkanes and alkenes.

A typical prior art process for hydrocarbon recovery, as described above, involves indirectly heating a material having absorbed hydrocarbons causing the hydrocarbons to volatilize. The volatized hydrocarbon vapors are then extracted, cooled and condensed. As a result of the heating process, even at low temperatures, a portion of the recovered hydrocarbon fluid may be degraded. As used herein, the term degraded simply means that at least one property of the hydrocarbon fluid is worse than a "pure" sample. For example, a degraded fluid may be discolored, may have a pungent odor, or may have increased viscosity. "Recovered" hydrocarbons, as used herein, relate to hydrocarbons which have been volatized off of a solid substrate and condensed through any known method.

In a first embodiment, the present invention involves contacting a cracked hydrocarbon fluid with a stream of ozone. Ozone is known as an oxidizing agent, and previous studies have shown that ozone does not react with saturated compounds such as alkanes and saturated fatty acids. It is also known that ozone will react with unsaturated compounds such as alkenes, unsaturated fatty acids, unsaturated esters and unsaturated surfactants. The present inventors have discovered that by passing ozone through cracked hydrocarbons, improved hydrocarbon fluids may result. In particular, the present inventors have discovered that a reduction in odor and an improved coloration may occur. Reducing odor is of significant concern because of the increased regulation of pollution in hydrocarbon production.

Embodiments of the present invention involve contacting a hydrocarbon fluid with an effective amount of ozone. An "effective amount," as used herein refers to an amount sufficient to improve a desired property (such as odor or color) in a hydrocarbon fluid. One of ordinary skill in the art would appreciate that the effective amount is a function of the concentration of the contaminants and the volume of the hydrocarbons to be treated.

Without being bound to any particular mechanism, the present inventors believe that the present invention operates through a chemical reaction known as ozonolysis. The reaction mechanism for a typical ozonolysis reaction involving an alkene is shown below:

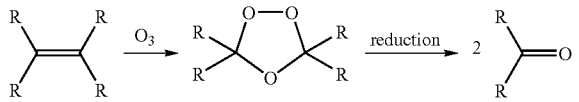

Thus, in the reaction, an ozone molecule ($O_3$) reacts with a carbon-carbon double bond to form an intermediate product known as ozonide. Hydrolysis of the ozonide results in the formation of carbonyl products (e.g., aldehydes and ketones). It is important to note that ozonide is an unstable, explosive compound and, therefore, care should be taken to avoid the accumulation of large deposits of ozonide.

The efficacy of ozone as an agent to improve at least one property of a hydrocarbon fluid was investigated. In this embodiment, recovered hydrocarbons were used. One suitable source for the recovered hydrocarbons is described in U.S. patent application Ser. No. 10/412,720, which is assigned to the assignee of the present invention. That application is incorporated by reference in its entirety.

Another suitable source of recovered hydrocarbons is described in U.S. Pat. No. 6,658,757, which is assigned to the assignee of the present invention. That patent is incorporated by reference in its entirety. These two methods of obtaining recovered hydrocarbons are merely examples, and the scope of the present invention is not intended to be limited by the source of the hydrocarbon fluid to be treated.

In one embodiment, a 500 ml sample of recovered hydrocarbon was placed in a cylinder. Ozone was bubbled through the cylinder at a rate of 8 g per day. Commercial ozone generators are available from a variety of vendors. For this particular embodiment, a Prozone PZ2-1 ozone generator sold by Prozone International Inc. (Hunstville, Ala.) was used. The top of the cylinder remained open to the air, in order to avoid a build up of ozonide. However, a vacuum blower could also be used to continuously purge the ozonide. In this embodiment, it was discovered that by contacting the ozone with the recovered hydrocarbons for 48 hours, substantial improvement in the color and the odor of the recovered hydrocarbons was seen. As a baseline, a similarly sized sample of recovered hydrocarbon had air bubbled through it for the same period of time.

After 48 hours, the two samples were analyzed by GC/MS. FIGS. 1*a* and 1*b* show the results. FIG. 1*a* is a GC/MS scan of the recovered hydrocarbon that had air bubbled through it, while FIG. 1*b* is a GC/MS scan of the recovered hydrocarbon that was treated with ozone. Inspection of the scans reveals that the traces are very similar. This was expected as these samples comprise mostly saturated hydrocarbons which do not react with ozone.

Figure 2B:
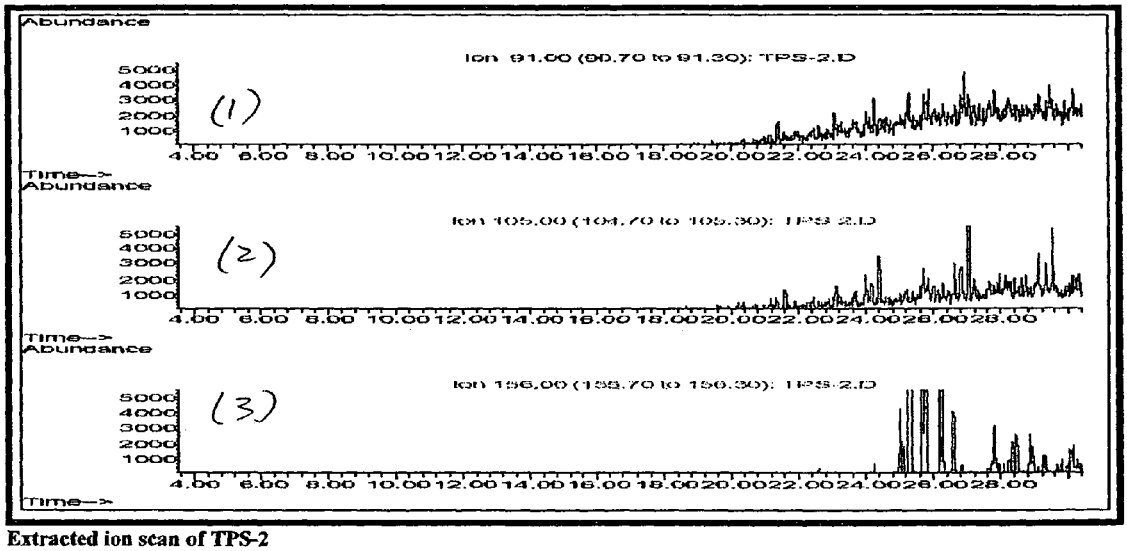
FIG. 2*b* is an extracted ion scan of a sample of hydrocarbon fluid treated in accordance with one embodiment of the present invention.

FIGS. 2*a* and 2*b* which are extracted ion scans (i.e., second MS analysis) of the two samples, however, show that ozonolysis has an effect on the recovered hydrocarbons. In FIG. 2*a* (the untreated sample), large amounts of xylene (panel 1) and benzene derivatives (panel 2) are present. In FIG. 2*b* (the treated sample), however, these peaks are not present, indicating that the ozone has selectively attacked the carbon-carbon double bonds present in these molecules. In contrast, panels 3 of FIG. 2*a* and FIG. 2*b* show that the saturated hydrocarbon $C_{11}H_{24}$, remains unchanged after ozonolysis. The reduction of the amount of unsaturated hydrocarbons leads to improved performance, odor, and color in the recovered hydrocarbon fluid.

To further understand the chemistry behind the reaction, the untreated fluid (i.e., recovered hydrocarbon contacted only with air) and the treated fluid were tested and analyzed on a GC/MS for paraffins, iso-paraffins, aromatics, napthenics, olefins, aldehydes, ketones, and acids (the latter three collectively called "other compounds"). The results are summarized in the table below:

TABLE 1

GC/MS data for treated vs. untreated fluid

| Compound | Untreated Fluid | Treated Fluid |
|---|---|---|
| Paraffin | 20.69% | 21.71% |
| Iso-paraffin | 27.56% | 32.14% |
| Aromatics | 13.27% | 10.67% |
| Naphthenics | 23.48% | 16.57% |
| Olefins | 2.97% | 3.69% |
| Other compounds | 11.94% | 15.22% |

The above table illustrates that the unsaturated aromatics and naphthenics are attacked by ozone, reducing their concentration in the treated fluid. These samples also contain low amounts of olefins. While the analysis does not show a reduction in olefin concentration, this is most likely due to the error inherent in the analysis.

In order to increase the reactivity of the ozone, a number of changes can be incorporated into the process. For example, the reaction vessel may be slightly pressurized in order to increase the solubility of the ozone in the hydrocarbon fluid. 7-8 psi is a preferred range, but those of ordinary skill will recognize that depending on the application, higher pressures may be used. Further, because the ozonolysis reaction is believed to be driven by the surface area of the ozone bubbles, ultrasonic systems may be used to decrease the size of individual ozone bubbles, leading to increased contact, which, in turn, increases the rate of the ozonolysis reaction. In addition, those having ordinary skill in the art will appreciate that another way to get improved contact is by using long, narrow columns of fluid, and passing the ozone through such a column.

The removal of organochlorine substances or microorganisms may also be accomplished by a cavitation phenomenon using ultrasound and injections of ozone, peroxides, and/or catalysts, such as within JP-900401407 (Ina Shokuhin Kogyo), JP-920035473 (Kubota Corp.), JP-920035472 (Kubota Corp.) and JP-920035896 (Kubota Corp.). Further the use of ultrasound with or without ozone is reported for the treatment of sewage sludge. Thus, it is contemplated that the combination of ozone and ultrasound (either low frequency or high frequency) may provide additional benefits to the treatment process described herein. For example, a tank with a sparger for ozone and a source for ultrasound may provide enhanced processing of the recovered oil. Alternatively, a continuous flow process (either concurrent flow or counter flow) in which ultrasound is introduced is contemplated as being within the scope of the present invention.

Depending on the particular amount of hydrocarbon liquid to be treated, a selected amount of ozone per day may be used. Further, the methods and apparatuses of the present invention may be used as a batch process, whereby barrels of hydrocarbon fluids are transported to a different location for ozone treatment, or they may be used in a continuous recovery process, whereby the ozone is added during the recovery process. Those having ordinary skill will recognize that continuous recovery may be used in either the process described in U.S. patent application Ser. No. 10/412,720 or U.S. Pat. No. 6,658,757.

Figure 3:
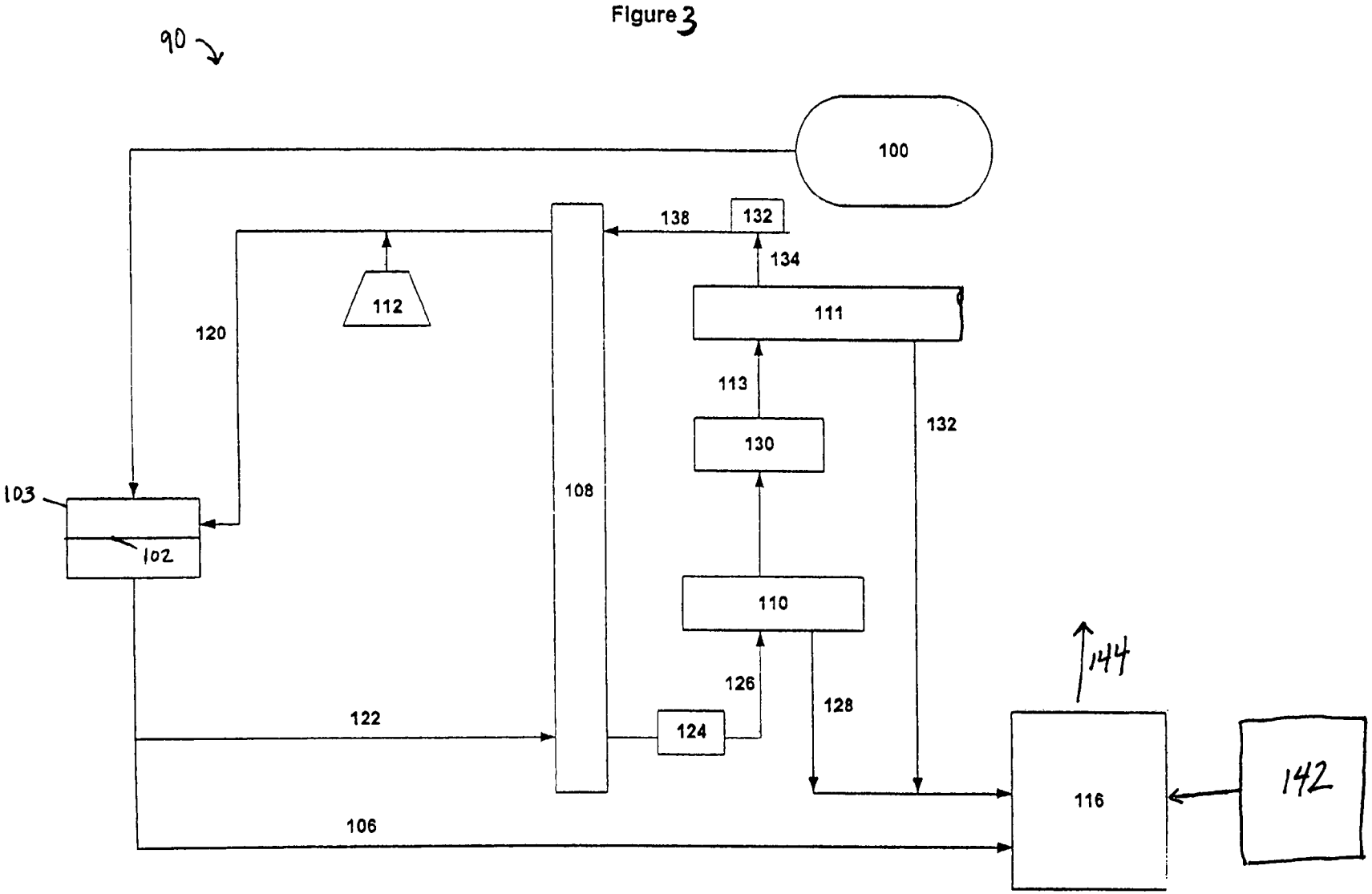
FIG. 3 shows an apparatus for ozone treatment in accordance with one embodiment of the invention.

FIG. 3 illustrates an apparatus in accordance with an embodiment of the present invention. FIG. 3 shows an embodiment of an apparatus 90 for improving the properties of recovered hydrocarbons from wellbore cuttings 100. In the embodiment shown in FIG. 3, cuttings 100 contaminated with, for example, oil-based drilling fluid and/or hydrocarbons from the wellbore (not shown) are transported to the surface by a flow of drilling fluid returning from the drilled wellbore (not shown). The contaminated cuttings 100 are deposited on a process pan 102. In some embodiments, the cuttings 100 may be transported to the process pan 102 through pipes (not shown) along with the returned drilling fluid. In other embodiments, the cuttings 100 may be, for example, processed with conveying screws or belts (not shown) before being deposited in the process pan 102. The process pan 102 is then moved into a process chamber 103 via, for example, a fork lift (not shown separately in FIG. 3). For example, in some embodiments of the invention, the process pan 102 may be rolled in and out of the process chamber 103 on a series of rollers.

In other embodiments, the process pan 102 may be moved vertically in and out of the process chamber 103 with, for example, hydraulic cylinders. Accordingly, the mechanism by which the process pan 102 is moved relative to the process chamber 103 is not intended to be limiting. Moreover, some embodiments of the apparatus 90 may comprise a plurality of process chambers 103 and/or a plurality of process pans 102.

Other embodiments, such as the embodiment shown in FIG. 3, comprise a single process pan 102/process chamber 103 system. Furthermore, the number of process pans 102 and process chambers 103 need not be the same.

The process chamber 103 includes, in some embodiments, a hydraulically activated hood (not shown) that is adapted to open and close over the process chamber 103 while permitting the removal or insertion of the process pan 102. After the process pan 102 has been inserted into the process chamber 103, the hydraulically activated hood (not shown) may be closed so as to "seal" the process chamber 103 and form an enclosed processing environment. The hood (not shown) may then be opened so that the process pan 102 may be removed.

After the process pan 102 has been positioned in the process chamber 103, heated air, which has been heated by a heating unit 112 (which may be, for example, a propane burner, electric heater, or similar heating device), is forced through the contaminated cuttings 100 so as to vaporize hydrocarbons and other volatile substances associated or adsorbed thereto. The heated air enters the process chamber 103 through, for example, an inlet duct 120, pipe, or similar structure known in the art. The heated air, which may be heated to, for example, approximately 400° F., is forced through the process pan 102 by, for example, a blower (not shown).

However, a blower may not be necessary in some embodiments if the pressure in the air circulation system is maintained at a selected level sufficient to provide forced circulation of the heated air through the contaminated cuttings 100. As the heated air is forced through the process pan 102, the air volatilizes the hydrocarbon and other volatile components that are associated with the cuttings 100. The hydrocarbon rich air then exits the bottom of the process chamber 103 through, for example, an outlet duct 122 and passes through a heat recovery unit 108. The heat recovery unit 108 recaptures some of the heat from the hydrocarbon rich air and, for example, uses the recaptured heat to heat additional hydrocarbon free air that may then be recirculated through the process chamber 103 through the inlet duct 120. Some hydrocarbons, water, and other contaminants from the contaminated cuttings 100 may be directly liquefied as a result of the forced-air process. These liquefied hydrocarbons, water, and/or other contaminants flow out of the process chamber 103 and through a process chamber outlet line 106.

After passing through the heat recovery unit 108, the hydrocarbon rich air is drawn through a series of filters 124 that are adapted to remove particulate matter from the air. The hydrocarbon rich air is then passed through an inlet 126 of a first condenser 110. Note that the inlet 126 of the first condenser 110 is typically operated under a vacuum to control the flow of hydrocarbon rich air. The vacuum at the inlet 126 may be produced, for example, by a vacuum pump (not shown separately in FIG. 3).

The first condenser 110 further comprises cooling coils (not shown separately in FIG. 3) adapted to condense the volatilized hydrocarbons (and, for example, an water vapor and/or other contaminants) in the hydrocarbon rich air into a liquid form. The liquefied hydrocarbons and contaminants are then removed through, for example, a condenser outlet 128 that conveys the liquefied hydrocarbons and contaminants to an oil/water separator 116. The apparatus 90 may also comprise, for example, pumps (not shown) that may assist the flow of liquefied hydrocarbons and contaminants from the condenser outlet 128 to the oil/water separator 116.

After passing through the first condenser 110, the cooled air then flows through a second series of filters and cooling coils 130 and into a second condenser 111 that operates at or near atmospheric pressure. The second condenser 111 boosts the pressure of the ambient airflow, and any additional condensate is removed from the process stream through an outlet 132 that transports the additional condensate to the oil/water separator 116.

An ozone generator 142 is connected to the oil/water separator 116. The ozone generator 142 is arranged to provide a selected amount of ozone (usually selected in grams per day) into the oil/water separator 116. In a preferred embodiment, the oil/water separator 116 comprises long, narrow columns, so that the contact area of the ozone is increased. Further, in some embodiments, an ultrasonic system (not separately shown) is coupled to the oil/water separator 116 to increase the ozone contact area. Further, in certain other embodiments, the oil/water separator 116 may be placed under pressure to increase the amount of ozone that can dissolve in the system. The oil/water separator 116 may further comprise a vent 144 to allow built up gases to evacuate the system, or may be attached to a vacuum blower, for example. Those having ordinary skill in the art will recognize that although the above embodiment describes a multi-condenser system, some embodiments contemplate the use of only a single condenser. Those having ordinary skill will appreciate that the ozone generator is operatively coupled to a recovered hydrocarbon fluid, and that the operative coupling may take place in a variety of ways.

In an alternative embodiment, contaminated material (i.e., solids containing adsorbed hydrocarbons) may first be screened to remove stones, rocks, and other debris, and then deposited into a feed hopper. The contaminated material may be fed directly into a feed hopper, or fed from a feed hopper into a lump breaker by a horizontal conveyor belt. From the lump breaker, the contaminated material is discharged onto an inclined conveyor belt for delivery to a feed hopper that directs the contaminated material to rotary paddle airlock valves.

Upon passing through the airlock valves, the contaminated substrate drops into an extraction chamber (also referred to as "processing chamber") and is moved through the extraction chamber by an auger screw. As the contaminated material moves though the extraction chamber, the contaminated material is indirectly heated by a combustion system that supplies heat to the extraction chamber from burners located externally and underneath the extraction chamber. The contaminated substrate remains physically separated from the combustion system by the extraction chamber's steel shell.

An enclosure referred to as "firebox" houses the extraction chamber and burners of the combustion system. As eluded to above, the firebox derives its heat by the combustion of commercially available fuels. The heat can be varied so that the temperature of the contaminated substrate is elevated to the point that the contaminants in the contaminated material are volatilized.

The treated substrate is then passed through a rotary airlock valve at the end of the extraction chamber and become available for rewetting and reintroduction to the environment. The volatilized contaminants are removed from the extraction chamber and directed to a vapor handling system.

The volatilized water and contaminants generated in the extraction chamber are subject to a vapor/gas condensation and clean-up system for the purpose of collection and recovery of the contaminants in liquid form. An ozone generator may then be operatively connected to the contaminants, which comprise hydrocarbon fluids, in order to treat the fluid. The vapor/gas condensation and clean-up system preferably includes a plurality of steps. First, the hot volatilized vapors/gases from the extraction chamber are cooled through direct contact water sprays in a quench header and the water required by the quenching process is provided by spray nozzles spaced at regular intervals along the quench header.

Second, the vapor/gas stream is then directed through one or more knock-out pots to remove residual particulate matter and large water droplets. Third, the vapor stream is subjected to a water impinger to further remove finer particulate matter and smaller water droplets. Fourth, the relatively dry vapor/gas stream of non-condensable gases is subject to one or more mist eliminators for aerosol removal. Fifth, the vapor/gas stream may be passed through a high efficiency air filtration system to remove any submicron mists or particles still remaining in the vapor/gas stream.

Glass media may be used in the filter system to filter material down as a microlite, and, as such, the filters remove liquid mist down to a 0.05 micron level. Finally, the vapor/gas stream may be subjected to a final polishing in a series of carbon absorption beds and subsequently vented to the atmosphere or returned to the burners of the combustion system. The ozone generator may be attached at a number of positions in the above embodiments, but should preferably be attached in a fashion to avoid placing significant heat on the ozonide formed during the ozonolysis reaction, to reduce the chance of an explosion.

In addition, those having ordinary skill in the art will recognize that the rate (i.e., the amount of ozone per day) may be varied, depending on a particular application in order to optimize treatment of recovered hydrocarbon fluids. Further, the reaction time (i.e., the length of time that the hydrocarbon fluids are subjected to ozone) may vary depending on the particular application. Still further, the extent of reaction (i.e., the amount of double bonds broken) may vary, depending on the amount of degradation that has occurred, and the desired end properties of the hydrocarbon fluid. Advantageously, embodiments of the present invention provide an improvement in at least one property of a "cracked" hydrocarbon fluid.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of treating a hydrocarbon fluid, comprising:

passing a stream of heated air over contaminated wellbore cuttings to volatilize hydrocarbons disposed thereon;

passing the stream of heated air containing the hydrocarbons through a first condenser to form the hydrocarbon fluid;

collecting the hydrocarbon fluid; and contacting the hydrocarbon fluid with an effective amount of ozone to change the color and/or reduce the odor.

2. The method of claim 1, further comprising:

pressurizing the hydrocarbon fluid and the ozone.

3. The method of claim 1, further comprising:

introducing ultrasound to the hydrocarbon fluid and the ozone.

4. The method of claim 2, wherein the passing the stream of heated air containing the hydrocarbons through a first condenser forms a cooled air stream.

5. The method of claim 4, further comprising:

passing the cooled air stream through a second condenser to remove any remaining hydrocarbons.

6. A method for separating contaminants from contaminated wellbore cuttings, comprising:

supplying the contaminated wellbore cuttings to a processing chamber;

moving the contaminated wellbore cuttings through the processing chamber;

heating the contaminated wellbore cuttings by externally heating the processing chamber so as to volatilize the contaminants in the contaminated wellbore cuttings;

removing vapor resulting from the heating, wherein the vapor comprises the volatilized contaminants;

collecting, condensing, and recovering the volatilized contaminants; and contacting the volatilized contaminants with an effective amount of ozone to change the color and/or reduce the odor.

7. The method of claim 6, wherein the heating comprises using a firebox.

8. The method of claim 7, further comprising:

shielding the heating using heat shields positioned between the processing chamber and the firebox.

9. The method of claim 6, further comprising:

introducing ultrasound to the hydrocarbon fluid and the ozone.

10. The method of claim 6, further comprising:

quenching the volatilized contaminants with water.

11. The method of claim 6, further comprising:

removing residual particulate matter and water droplets from the volatilized contaminants.

* * * * *